US005219164A

United States Patent [19]

Peng

[11] Patent Number: 5,219,164

[45] Date of Patent: Jun. 15, 1993

[54] SHOCK ABSORBING BASEBALL BAT

[76] Inventor: Jung-Ching Peng, 2/F, 9-1, Lane 161, Hsing An Road Sec. 1, Taichung, Taiwan

[21] Appl. No.: 708,504

[22] Filed: May 31, 1991

[51] Int. Cl.[5] ..... A63B 59/06

[52] U.S. Cl. ..... 273/72 R; 273/72 A; 273/26 B

[58] Field of Search ..... 273/67 R, 67 D, 67 DA, 273/72 R, 72 A, 73 J, 73 C, 80 B, 4, 26 B; 81/22

[56] References Cited

U.S. PATENT DOCUMENTS

| | | | |
|---|---|---|---|
| 1,665,195 | 4/1928 | Cohn | 273/72 R |
| 2,023,131 | 12/1935 | Gibson | 273/80 B |
| 2,153,880 | 4/1939 | Barnhart | 273/80 B |
| 2,603,260 | 7/1952 | Floren | 273/73 J |
| 2,757,694 | 8/1956 | Curtis | 81/22 |
| 3,479,030 | 11/1969 | Merola | 273/72 A |
| 3,877,698 | 4/1975 | Volpe | 273/72 R |
| 4,609,198 | 9/1986 | Tarr | 273/73 J |
| 4,951,948 | 8/1990 | Peng | 273/72 R |

*Primary Examiner*—William H. Grieb
*Assistant Examiner*—Steven B. Wong

[57] ABSTRACT

A shock absorbing baseball bat comprising an elongate main body with a rear entrance formed on a rear taper section thereof, an elongate tapering stem concentrically disposed within the main body with the front end thereof in proximity to the front end of the main body and the rear end thereof extending to the rear of the rear entrance, a handle secured to the rear portion of the stem, an elastic guard piece disposed circumferentially between the main body and the stem immediately forward of the handle, and an elastic end piece disposed circumferentially between the front end portion of the main body and the front end portion of the stem. Both the end piece and guard piece are made from a liquid casting compound molded directly within the bat, and serve to absorb concomitant shock and vibration created by the impact of a ball with the main body.

2 Claims, 4 Drawing Sheets

SHOCK ABSORBING BASEBALL BAT

BACKGROUND OF THE PRESENT INVENTION

The present invention relates to a shock absorbing baseball bat and more particularly to an improved structure shock absorbing baseball bat that is simple to manufacture and that has improved characteristics.

Though shock absorbing baseball bats are known from the prior art, in particular with reference to U.S. Pat. No. 4,951,948 (Aug. 28, 1990) by the present inventor, the shock absorbing baseball bat of the present invention offers features not previously found in the bats of the prior art.

The above mentioned prior art reference cites an elastic ring member, with an internal gas bladder, and an elastic connector, such as a spring, disposed between the main body and the central handle of the shock absorbing baseball bat.

The elastic ring member and elastic connector must be separately manufactured and assembled with the other members of the bat, whereas in the shock absorbing bat of the present invention, the elastic members are formed integrally within the structure of the bat by a casting technique and are intimately in contact with the main body and stem of the bat, and strongly adheres thereto.

This not only provides a bat of improved shock and vibration absorbing characteristics but also increases the sturdiness of the bat.

As the elastic ring of the above mentioned reference usually requires various recessed areas to be formed within the main body in contact therewith, the structure of the main body would be significantly weakened.

The elastic connector would also require various appendages or threaded areas to be formed on corresponding members of the bat, which increases the manufacturing complexity and also adversely affects the integrity of the bat's structure.

In the shock absorbing baseball bat of the present invention, an elastic end piece and guard piece are directly formed between a main body and a stem at respective front and rear portions thereof, and which do not require separate assembly or pre-formed recessed or protruding mating surfaces on the main body or stem for securement therein.

As such, the improved structure shock absorbing baseball bat of the present invention provides a shock absorbing baseball bat that is simple to manufacture and that has a sturdier more integral structure.

SUMMARY OF THE PRESENT INVENTION

The shock absorbing baseball bat of the present invention has as a first objective to provide a shock absorbing baseball that absorbs the concomitant shock and vibration created therein by the impact of a ball, and a second objective of providing a shock absorbing baseball bat that is simple to manufacture and that has an integral and sturdy structure.

The shock absorbing baseball bat of the present invention comprises an elongate hollow main body with a rear taper section on which is formed a round rear entrance on the rear end thereof, an elongate tapering stem with a hollow interior, a handle provided on the rear end of the stem, and an elastic end piece and guard piece.

The stem is disposed within the main body with the front end of the stem in proximity to the front end of the main body and the handle on the rear end thereof disposed to the rear of the main body, with the front end of the handle separated from the rear entrance of the main body by a space.

The elastic guard piece is disposed circumferentially between the rear portion of the taper section of the main body and a rear portion of the stem immediately forward of the handle, being formed therebetween by direct casting from a liquid casting compound. The elastic guard piece also occupies the space between the handle and rear entrance.

A dowel with a central portion of reduced diameter is inserted through a pair of aligned through holes formed at pre-determined positions on the taper section and through a pair of aligned through holes formed at corresponding positions on the stem, with the dowel passing through the guard piece.

The guard piece has an inner portion formed within the interior of the stem that communicates with the portion of the guard piece disposed between the exterior of the stem and the taper section through spaces defined between the through holes formed in the stem and the dowel passing therethrough.

A rounded crown is formed on the front end of the main body having a hole thereon concentric with the stem and separated from the front end thereof by an annular space.

The elastic end piece is disposed circumferentially between the front portion of the main body and the front portion of the stem, being formed therrebetween by direct casting from a liquid casting compound in a similar manner as with the guard piece. The annular space between the concentric hole on the front end of the main body and the front end of the stem is also occupied by the end piece.

Thus, the end piece and guard piece are in intimate contact with the main body and stem elastically, but firmly securing the two together.

Upon the impact of a ball against the main body, concomitant shock and vibrations created in the bat are largely absorbed by the elastic end piece and guard piece.

The first and second objectives of the present invention are thereby achieved.

A detailed description of the structure and function of the shock absorbing baseball bat of the present invention along with accompanying drawings is given below.

A BRIEF DESCRIPTION OF THE DRAWINGS

FIG. 5 is an elevational view of an elongate carrier rod having counterweights and vibration absorbing elements releasably secured thereon.

PREFERRED EMBODIMENT OF THE PRESENT INVENTION

Figure 1:
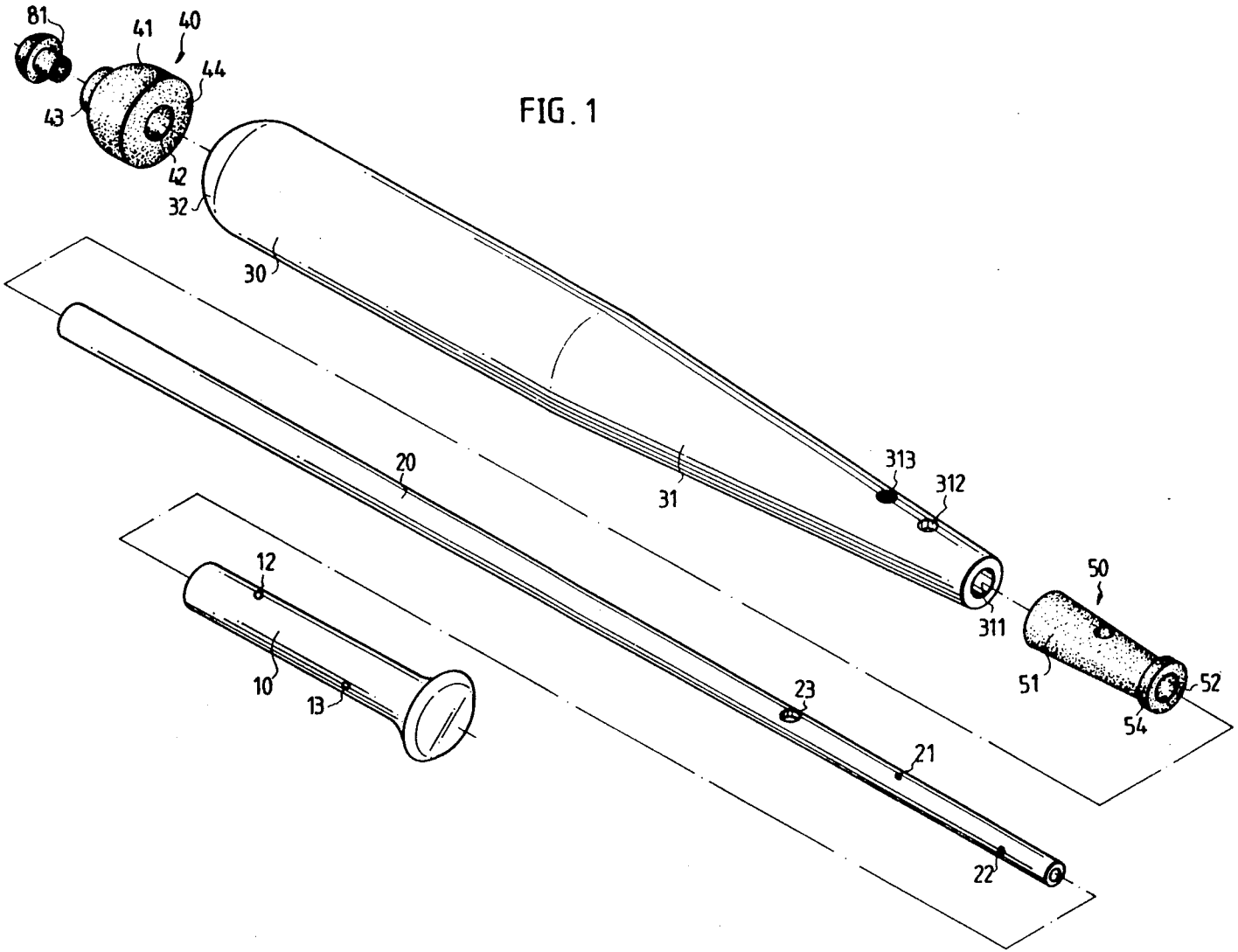
FIG. 1 is an exploded view of a preferred embodiment of the shock absorbing baseball bat of the present invention.

Referring to FIG. 1, an embodiment of the shock absorbing baseball bat of the present invention comprises an elongate handle 10 with an axial cavity 11 formed therein, a tapering tubular stem 20, a generally cylindrical, hollow main body 30 with a taper section 31 to the rear thereof, and an elastic, shock and vibration absorbing end piece 40 and guard piece 50.

Handle 10, stem 20, and main body 30 are manufactured from a composite synthetic material of high toughness and resilience, such as graphite fiber reinforced plastic.

Figure 2:
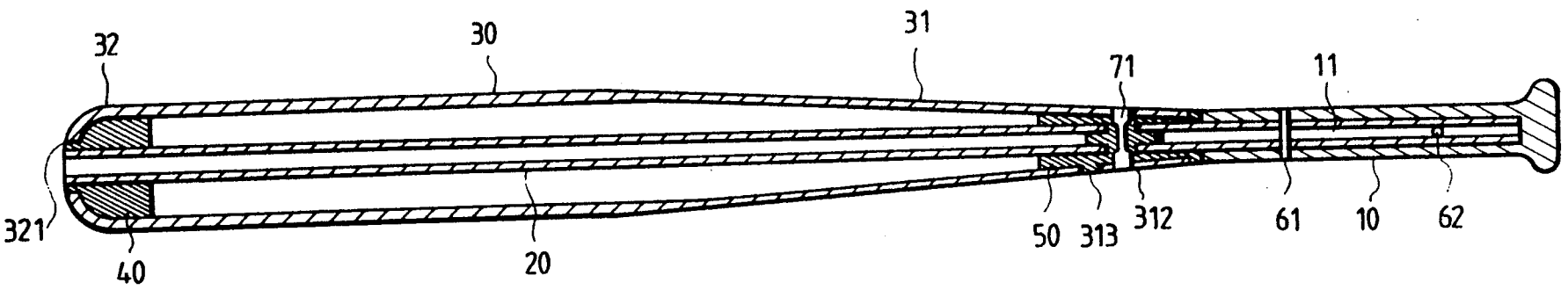
FIG. 2 is a cross-sectional view of a preferred embodiment of the shock absorbing baseball bat of the present invention, taken along line 1—1 of FIG. 4.

Referring also to FIG. 2, the rear end of tapering tubular stem 20, with a diameter less than that of the front end thereof is inserted into axial cavity 11 of handle 10 which has a shape and dimensions substantially conforming with that of the rear, outer portion of stem 20, hereinafter referred to as the handle portion, so as to make intimate contact therewith.

An enlarged, rounded hand guard is formed on the rear end of handle 10.

A first pair of aligned through holes 12 are formed on handle 10 near the front end thereof and a second pair of aligned through holes 13 are formed on handle 10 near the hand guard thereon, across the outer circumferential side thereof and with the mutual axis of the first pair of through holes 12 perpendicularly oriented with respect to the mutual axis of the second pair of through holes 13.

Likewise, a first pair of aligned through holes 21 and a second pair of aligned through holes 22 are formed at corresponding positions on stem 20 towards the front and rear of the handle portion thereon, respectively, so that the first and second pair of aligned through holes 21 and 22 thereon can be aligned with respective pairs of through holes 12 and 13 formed on handle 10.

The first pair of through holes 21 on stem 20 can be formed simultaneously with the first pair of through holes 12 on handle 10 by drilling across the outer circumferential side of handle 10 with the handle portion of stem 20 disposed therein. The respective second pairs of through holes 22 and 13 of handle 10 and stem 20 can likewise be formed in a similar manner, obviating the need for pre-alignment of stem 20 and handle 10 which would be required in the case of through holes formed independently on handle 10 and stem 20 prior to insertion therein.

A first and second steel pins 61 and 62 are respectively inserted through aligned first pairs of through holes, 12 and 21, and aligned second pairs of through holes, 13 and 22, and tightly secured therein by pressure fit to rigidly secure stem 20 to handle 10.

Figure 4:
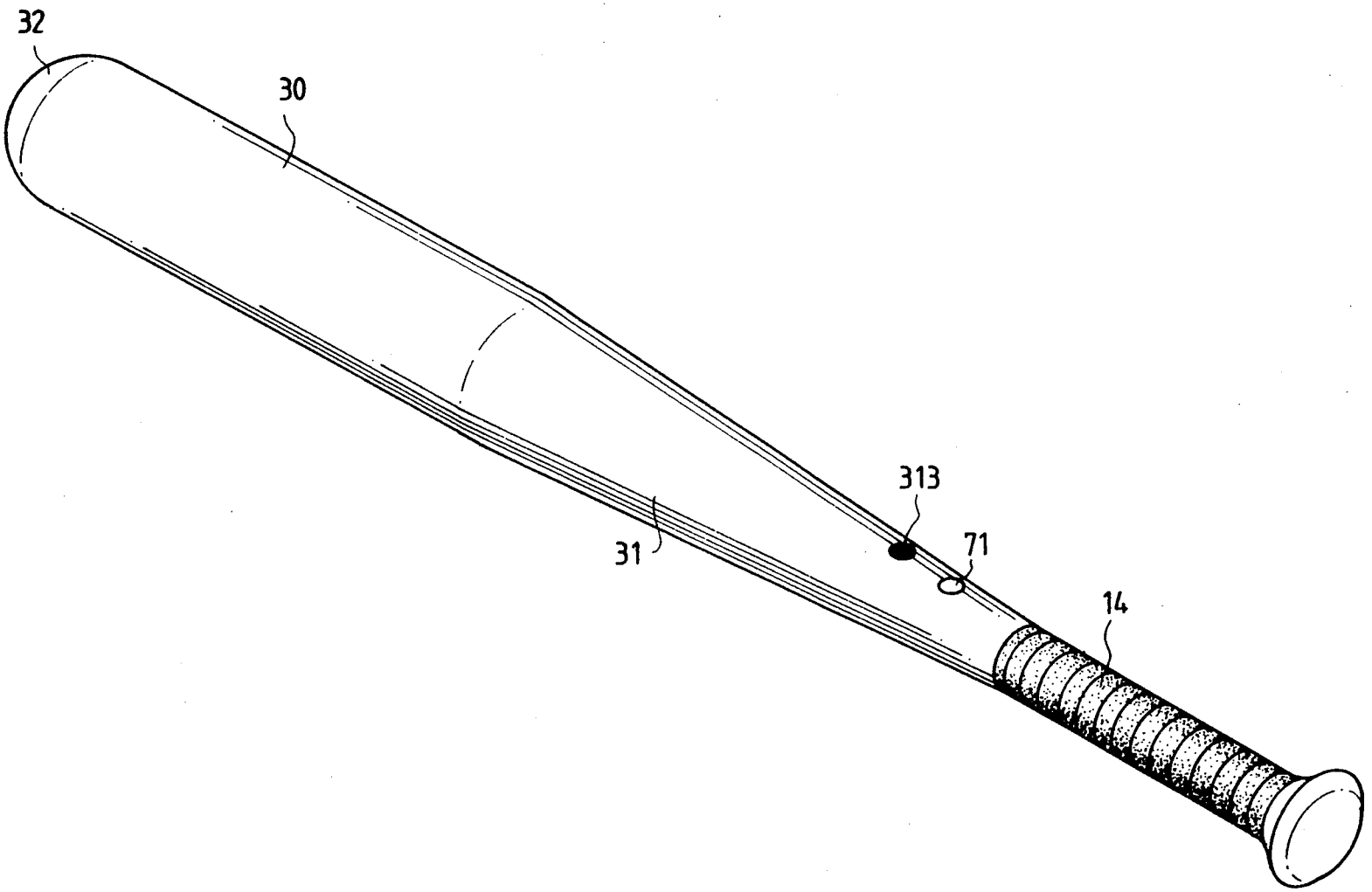
FIG. 4 is a perspective view of an assembled preferred embodiment of the shock absorbing baseball bat of the present invention.

A hand grip 14 can be provided on handle 10 by wrapping a tape, made from a suitable material such as polyurethane, around the outer circumference thereof, which also serves to cover the exposed ends of pins 61 and 62 from view, as shown in FIG. 4.

Elastic guard piece 50 has roughly infundibiliform shape with a tapering outer circumferential side 51, a tapering, concentric inner cavity 52, a flattened annular top side 53, and an annular flange 54 protruding from the bottom of outer circumferential side 51.

Elastic guard piece 50, as with end piece 40, is formed from a room temperature curing synthetic casting compound, such as a suitable type of epoxy resin, that is cast directly between handle 10, stem 20, and main body 30 and is thus integral therewith and is not a separately manufactured and assembled component as might be inferred from the depiction of FIG. 1.

To form guard piece 50, stem 20 with handle 10 secured to the rear end thereof is first inserted into main body 30 through a circular entrance 311 formed on the rear of taper section 31 thereon, and held in a relative, concentric position such that a space of pre-determined distance separates circular entrance 311 from the front end of handle 10.

Figure 3:
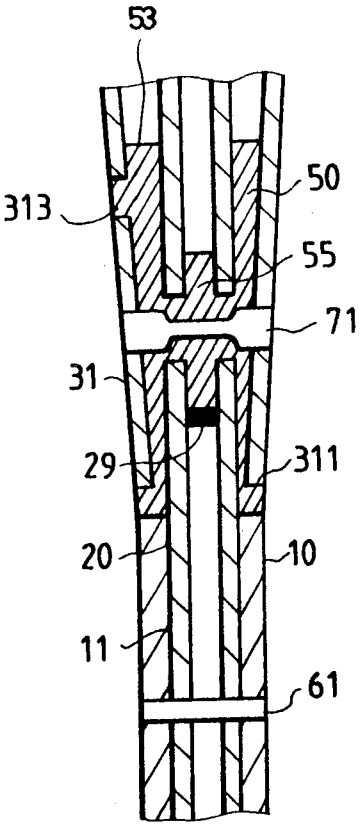
FIG. 3 is an cross-sectional view of an elastic guard piece and surrounding elements of a preferred embodiment of the shock absorbing baseball bat of the present invention.

Referring to FIG. 3, a pair of aligned through holes 312 are formed at pre-determined positions on taper section 31, across the outer circumferential side thereof. Likewise, a pair of aligned through holes 23 are formed at corresponding positions on stem 20, such that when main body 30 and stem 20 are held in relative position as described above, stem 20 is also rotated to a proper relative orientation therewith to align the pair of through holes 23 on stem 20 with the pair of through holes 312 on taper section 31.

A stainless steel dowel 71 has a constricted central portion 711 of lesser diameter than the end portions of dowel 71, and adjoins with the end portions on either side thereof through rounded shoulder portions 712, which have shapes of pre-determined dimensions. The span between shoulder portions 712 is slightly greater than the diameter of stem 20 at the position of the pair of through holes 23 thereon.

Dowel 71 is inserted through aligned pairs of through holes, 312 and 23, on taper section 31 and stem 20, respectively. A space is defined between each rounded shoulder portion 712 and a respective through hole 23 on stem 20, hereinafter referred to as the channel space, through which the interior of stem 20 communicates with the exterior thereof.

The terminal ends of dowel 71 are flush with the outer circumferential side of taper section 31.

A pre-determined amount of liquid casting compound is then poured through a gate hole 313 formed at a pre-determined position on the outer circumferential side of taper section 31 forward from the pair of through holes 312 thereon, with main body 30 and stem 20 aligned in a vertical direction, and handle 10 in a lower position.

A releasably secured sealing ring, such as a two piece annular former, is attached to the assembly covering the space separating circular entrance 311 and the front end of handle 10, mounting flush with the outer circumference thereof and containing the liquid casting compound therebetween.

The space between the tapering inner circumferential side of the rear portion of taper section 31 and tapering outer circumferential side of the portion of stem 20 forward of the handle portion thereof, along with the space between circular entrance 311 and the front end of handle 10, defines a mold cavity for the forming of guard piece 50.

Tapering outer circumferential side 51 and tapering inner cavity 52 of guard piece 50 are thus respectively in intimate contact with the inner circumferential side of the rear portion of taper section 31 and the outer circumferential side of the corresponding portion of stem 20, and strongly adheres thereto.

Likewise, annular flange 54 is formed in the space separating entrance 311 and the front end of handle 10, and is flush with with the adjoining outer circumferential sides of taper section 31 and handle 10.

Flattened top side 53 of guard piece 50 is formed by the influence of gravity and upon curing is substantially level and perpendicular with the longitudinal axis of the bat, as the assembly is positioned in a vertical orientation.

The rear portion of main body 30 is thus elastically but firmly secured to a rear portion of stem 20, immediately forward of handle 10, by elastic guard piece 50.

Gate hole 313 is sealed to be flush with with the adjoining outer circumferential side of taper section 31.

A round tapered plug 29 made from an elastic material and of a suitable diameter, pre-inserted into the hollow interior of tubular stem 20 before securement of handle 10 therewith, is disposed at a pre-determined position therein between dowel 71 and the position of the front end of handle 10.

Guard piece 50 has an inner portion 55 formed within stem 20 by providing a quantity of liquid casting compound within the hollow interior of stem 20 above plug 29 to a level below that of top side 53 to the exterior of stem 20.

As the interior of stem 20 communicates with the molding cavity between the inner circumferential side of taper section 31 and the outer circumferential side of stem 20, through the channel spaces, inner portion 55 within stem 20 forms an integral part of guard piece 50.

Liquid casting compound can be poured directly into the hollow interior of stem 20 or can overflow from the molding cavity between stem 20 and taper section 31, through the channel spaces, or a combination of both methods can be used.

As the liquid casting compound has a relatively high viscosity that varies with temperature and time and the channel spaces are relatively narrow, the relative levels of casting compound within stem 20 and the molding cavity to the exterior thereof can readily be controlled by varying the times and rates of pouring into the respective containing areas. As such, the cured guard piece 50 will have a top side 53 formed further upwards than the top side of inner portion 55 within stem 20.

Referring to FIG. 2, end piece 40 is formed in a similar manner as with guard piece 50 and has a rounded front portion 41, a concentric tapered through hole 42 with a protruding annular rim 43 on the front thereof, and a flattened rear side 44.

With guard piece 50 fully cured and securing together the rear portions of main body 30 and stem 20, the assembly is inverted so that a rounded crown 32 defined by on the front end of main body 30 is in a lowered position.

The front end of stem 20 is even with the frontmost portion of crown 32, on which is formed a concentric hole 321 of greater diameter than the front end of stem 20 and defines a space therebetween.

A disk shaped former of suitable shape and dimensions is positioned against crown 32, abutting the front end thereof and the front end of stem 20. A gate hole is provided on the former at a position thereon corresponding to a position under the annular space separating stem 20 from concentric hole 321.

A pre-determined amount of liquid casting compound is then injected through the gate hole of the disk shaped former.

The space between the round inner side of crown 32, including the adjoining inner circumferential side of the front portion of main body 30, and the outer circumferential side of the front portion of stem 20, along with the annular space between stem 20 and concentric hole 321 defines a mold cavity for end piece 40.

Rounded front portion 41 along with adjoining circumferential sides thereon and tapered through hole 42 of end piece 40 are thus respectively in intimate contact with the round inner side of crown 32 and the outer circumferential side of the front portion of stem 20, and strongly adheres thereto.

Likewise, annular rim 43 of end piece 40 is formed in the space between stem 20 and concentric hole 321, and is flush with the adjoining outer side of crown 32 and front end of stem 20.

Flattened rear side 44 of end piece 40 is formed by the influence of gravity and upon curing is substantially level and perpendicular with the longitudinal axis of the bat.

The front portion of main body 30 is thus elastically but firmly secured to the front portion of stem 20 by elastic end piece 40.

FIG. 4 shows an assembled shock absorbing baseball bat of the present invention.

When main body 30 of the shock absorbing baseball bat of the present invention strikes a ball, elastic end piece 40 and guard piece 50 therein substantially deform with stem 20 being displaced laterally with respect to main body 30. This action strongly reduces the shock which would normally be largely transmitted to the arms of a batter using a conventional rigid wooden or metallic bat.

Elastic end piece 40 and guard piece 50 very quickly rebound to their original shapes to return the energy stored therein by their deformation to the ball, adding impetus thereto, and return stem 20 and main body 30 to their original relative orientation.

As annular flange 54 of guard piece 50 physically separates main body 30 from handle 10, concomitant vibrations in main body 30 are largely absorbed in guard piece 50 before they reach handle 10 and a batter's hands.

Further, concomitant vibrations in stem 20 are also largely absorbed by guard piece 50, with inner cavity 52 and inner portion 55 thereof being in intimate contact with respective outer and inner circumferential sides of stem 20.

End piece 40 and guard piece 50 also greatly reduces the resultant noise and ringing caused by a ball's impact with the bat, which is markedly present in the case of metallic bats.

In addition to the advantages mentioned in the background, note also that no separately manufactured and assembled elastic shock absorbing elements requiring expensive molds are utilized in the shock absorbing bat of the present invention.

Moreover, being made from a fiber reinforced composite, no secondary finishing of the outer surface of main body 30 to provide coloration or artwork thereon is required as these can be directly applied to the surface thereof during its manufacture which would not be possible with a wooden or metallic bat.

End piece 40 and guard piece 50 are both formed within the the shock absorbing bat of the present invention as was described above and form a far more integral and sturdy bat than would be possible with a bat employing separately assembled shock absorbing elements.

The shock absorbing bat of the present invention is very suited for carrying weight and balance adjusting counterweights.

Through the front end of stem 20 is normally sealed with an elastic cap 81, as shown in FIG. 1, a suitably shaped counterweight can also be used as a substitute.

Referring to FIG. 5, for greater control of the weight and balance of the bat, an elongate carrier rod 90 releasably securable within stem 20 can be provided on which one or more counterweights 91 can be attached at selected positions thereon, as is known from weight adjustable bats of the prior art.

Suitably shaped elastic members 92 could also be attached to the carrier rod to contact the inner circumferential side of stem 20 at selected positions therein and compliment guard piece 50 in attenuating vibration in stem 20.

Although, the above description contains many specificities, these should not be inferred as limitations on the scope of the present invention, but merely as one possible mode of realization of a preferred embodiment thereof.

Many variations of the structural details of the shock absorbing baseball bat of the present invention are possible. For example, though only one dowel 71 was specified, a number of dowels passing through corresponding aligned pairs of through holes formed on taper section 31 and stem 20 at appropriate positions thereon can be provided, or the dowels can be dispensed with, with guard piece 50 communicating directly with inner portion 55 thereof through a plurality of through holes formed on stem 20 providing sufficient securement between main body 20 and stem 20.

As such the scope of the present invention should not be determined from the above exposition but by the appended claims.

I claim:

1. A shock absorbing baseball bat comprising:

an elongate hollow main body having an entrance formed on a rear end thereof adjacent to a grip portion of said bat and a circular hole formed on a front crown portion thereof;

an elongate stem having a hollow interior disposed within said main body, with a front end thereof in proximity to the circular hole on said crown portion of said main body which is concentric therewith, and a rear portion thereof extending through said entrance to the rear of said main body;

a handle provided on a rear portion of said stem and disposed to the rear of said main body, said handle being separated from said entrance to define a space;

an elastic end piece, made from a liquid casting compound, disposed circumferentially between a front end portion of said stem and a front end portion of said main body, and formed by direct casting of said compound therebetween;

an elastic guard piece, made from a liquid casting compound, disposed circumferentially between a rear portion of said main body and a rear portion of said stem forward of said handle, and formed by direct casting of said compound therebetween, said guard piece occupying the space between said handle and said entrance;

a plug disposed within the hollow interior of said stem at a predetermined and medial position between the longitudinal extremities of said guard piece;

an inner portion of said guard piece formed within the hollow interior of said stem forward of said plug and adjacent therewith, said inner portion communicating with the portions of said guard piece disposed circumferentially around said stem through at least one pair of through holes formed on said stem;

wherein said end piece and said guard piece elastically secure said main body to said stem and absorb concomitant shock and vibrations in said bat created by the impact of a ball with said main body.

2. A shock absorbing baseball bat according to claim 1, wherein:

a dowel passes through each pair of aligned said through holes on said stem and through a corresponding pair of aligned through holes formed on said main body.

* * * * *